US005125552A

United States Patent [19]

Medwed

[11] Patent Number: 5,125,552

[45] Date of Patent: Jun. 30, 1992

[54] BATTEN SETTING APPARATUS

[76] Inventor: Willibald Medwed, Koniger Strasse 27, 6123 Bad König, Fed. Rep. of Germany

[21] Appl. No.: 660,006

[22] Filed: Feb. 25, 1991

[30] Foreign Application Priority Data

Feb. 23, 1990 [DE] Fed. Rep. of Germany ..... 4005766

[51] Int. Cl.[5] ..... B27D 7/02; E04D 15/00

[52] U.S. Cl. ..... 227/156; 227/110; 52/749; 269/43; 269/904

[58] Field of Search ..... 227/110, 111, 7, 156, 227/152; 52/345, 749; 269/904, 43

[56] References Cited

U.S. PATENT DOCUMENTS

| | | | |
|---|---|---|---|
| 3,286,649 | 11/1966 | Hughes | 227/111 X |
| 3,298,584 | 1/1967 | Miller | 227/111 X |
| 3,619,895 | 11/1971 | Thompson | 227/111 X |
| 3,637,126 | 1/1972 | Heterick, Jr. | 227/7 X |
| 3,984,040 | 10/1976 | Fry | 227/111 X |
| 4,350,279 | 9/1982 | Haley | 227/110 X |
| 4,523,706 | 6/1985 | Haley | 227/110 X |

FOREIGN PATENT DOCUMENTS

| | | |
|---|---|---|
| 0347403 | 12/1989 | European Pat. Off. . |
| 2590921 | 5/1987 | France . |

*Primary Examiner*—Frank T. Yost
*Assistant Examiner*—Rinaldi Rada
*Attorney, Agent, or Firm*—Fleit, Jacobson, Cohn, Price, Holman & Stern

[57] ABSTRACT

Disclosed is a batten setting apparatus for laying and mounting batten strips in a desired distance to mounted batten strips on rafters or similar undergound. The apparatus includes a framework having a first row of abutment elements and a first row of pressure elements coupled to a motor for clamping a batten strip to be mounted there between. A second row of abutment elements is provided for positioning the apparatus at a mounted batten strip. The distance between the first row and the second row of abutment elements determines the distance of the batten strip to be mounted from the mounted batten strip.

15 Claims, 2 Drawing Sheets

BATTEN SETTING APPARATUS

BACKGROUND OF THE INVENTION

1. Field of the Invention

The invention refers to a batten setting apparatus for laying batten strips on a surface. Preferably the invention refers to an apparatus which allows for laying and mounting roof battens upon a field of rafters.

2. Description of Related Art

U.S. Pat. Specification No. 4,350,279 discloses a batten setter for laying batten strips on a surface at a predetermined distance from each other. The device comprises an H-like framework the legs of which have an adjustable length. A first transverse member is fixed to adjacent ends of both legs, and a second transverse member is fixed to the opposite adjacent ends of both legs. Abutment elements project from opposing surfaces of both transverse members and are adapted to hold a batten strip to be mounted in a predetermined distance to the last mounted batten strip.

A pair of transverse pressure beams are provided which extend parallel to the transverse members and are elastically mounted to the ends of the legs. Thereby, the last mounted batten strip may be gripped between the abutments elements of one of the transverse members and one of the pressure beams. and a batten strip to be mounted may be gripped between the opposing abutment elements and the other pressure beam.

This known device has a number of drawbacks. Firstly, after roofing by utilizing the known device the rows of tiles laid upon the batten strips are not exactly straight which results to an irregular appearance of the roof. Such irregularity occurs even if the batten strips are exactly straight. Secondly when manipulating said device it is difficult to insert a batten strip to be mounted between the abutments elements and the pressure beam because the latter is urged towards the abutments elements by means of two strong helical springs.

SUMMARY OF THE INVENTION

It is therefore an object of the invention to provide an improved batten setting apparatus. It is also an object underlying the invention to devise a batten laying apparatus which allows for laying and mounting batten strips in such a way, that the rows of tiles of the roof are straight and parallel. Yet another object underlying the invention resides in providing a batten setting apparatus by which the manipulation of a new batten strip to be laid and mounted is substantially eased.

To this end the invention provides for a batten setting apparatus having a framework including two opposite parallel transverse members. Each transverse member is provided with a longitudinal row of abutment elements such that the distance between both rows taken transversely to the longitudinal direction of each row corresponds to a predetermined batten distance. Pressure elements are arranged to a row parallel to the rows of abutment elements. At least one pressure motor is provided for urging the pressure elements towards an associated row of abutment elements. By deactivating the motor the pressure elements may be withdrawn to such extent that a new batten strip may easily be introduced between the associated row of abutment elements and the pressure elements. When energizing the motor an introduced batten strip to be mounted is forcefully clamped between the pressure elements and the associated abutment elements. The non-associated row of abutment elements then may engage a mounted batten strip for maintaining the desired distance during mounting of the introduced batten strip. The device according to the invention simplifies laying and mounting batten strips on rafters. Moreover, the accuracy of maintaining the desired distance between the rows of batten strips is improved. Last not least the device according to the invention processes even slightly warped batten strips because the pressure exerted by the motor driven pressure elements straightens such batten strip to the necessary uniformity.

Preferably, the motor may be driven by a hydraulic or pneumatic medium. Alternatively, the motor may be driven electrically.

According to a further improvement of the invention, the pressure elements are mounted to a clamping bar which is coupled to the motor and is pivotably mounted within the framework. According to yet another improvement of the invention the abutment elements project downwardly from a lower surface of the transverse member, and the pressure elements project downwardly from a lower surface of the clamping bar. Thereby, the framework may have a flat underside from which only the abutment elements and the pressure elements project. Thus, the batten setting apparatus according to the invention may be manually shifted along a mounted batten strip and a batten strip to be mounted. Preferably, both the abutment elements and the pressure elements include pulleys for rolling engagement of the batten strips. Shifting the apparatus along the batten strips is further eased if, according to yet another improvement of the invention, at least two sets of rollers are mounted to the framework so as to allow the apparatus to roll upon the batten strips.

The apparatus according to the invention may be further improved by arranging the row of pressure elements between both rows of abutment elements. In this embodiment deviatons of the width of the batten strips to be mounted cannot influence the desired distance between the mounted batten strips and the batten strips to be mounted.

Preferably, a second row of pressure elements coupled to a pressure motor may be provided such that a mounted batten strip may be clamped between the abutment elements of one transverse member and an associated row of pressure elements (hereinafter called second row of pressure elements), whereas a batten strip to be mounted may be clamped between the abutment elements of the other transverse member and the associated row of pressure elements (hereinafter called first row of pressure elements).

According to yet another improvement of the invention one of the transverse members may be accomodated within a slide groove of the framework and may be coupled to an adjustment means which allows for adjusting the distance between a mounted batten strip and a batten strip to be mounted to a desired value. The associated row of pressure elements then may be mounted to said adjustable transverse member.

The apparatus according to the invention may be equipped within an automatic nailer which may be driven by the same energy source to which the motor is coupled. The nailing head may be mounted between the row of abutment elements and the associated first row of pressure elements for receiving a batten to be nailed.

BRIEF DESCRIPTION OF THE DRAWINGS

A presently preferred embodiment of the invention is disclosed in the attached drawings which are explained hereinafter in detail.

DESCRIPTION OF THE PREFERRED EMBODIMENT

Figure 1:
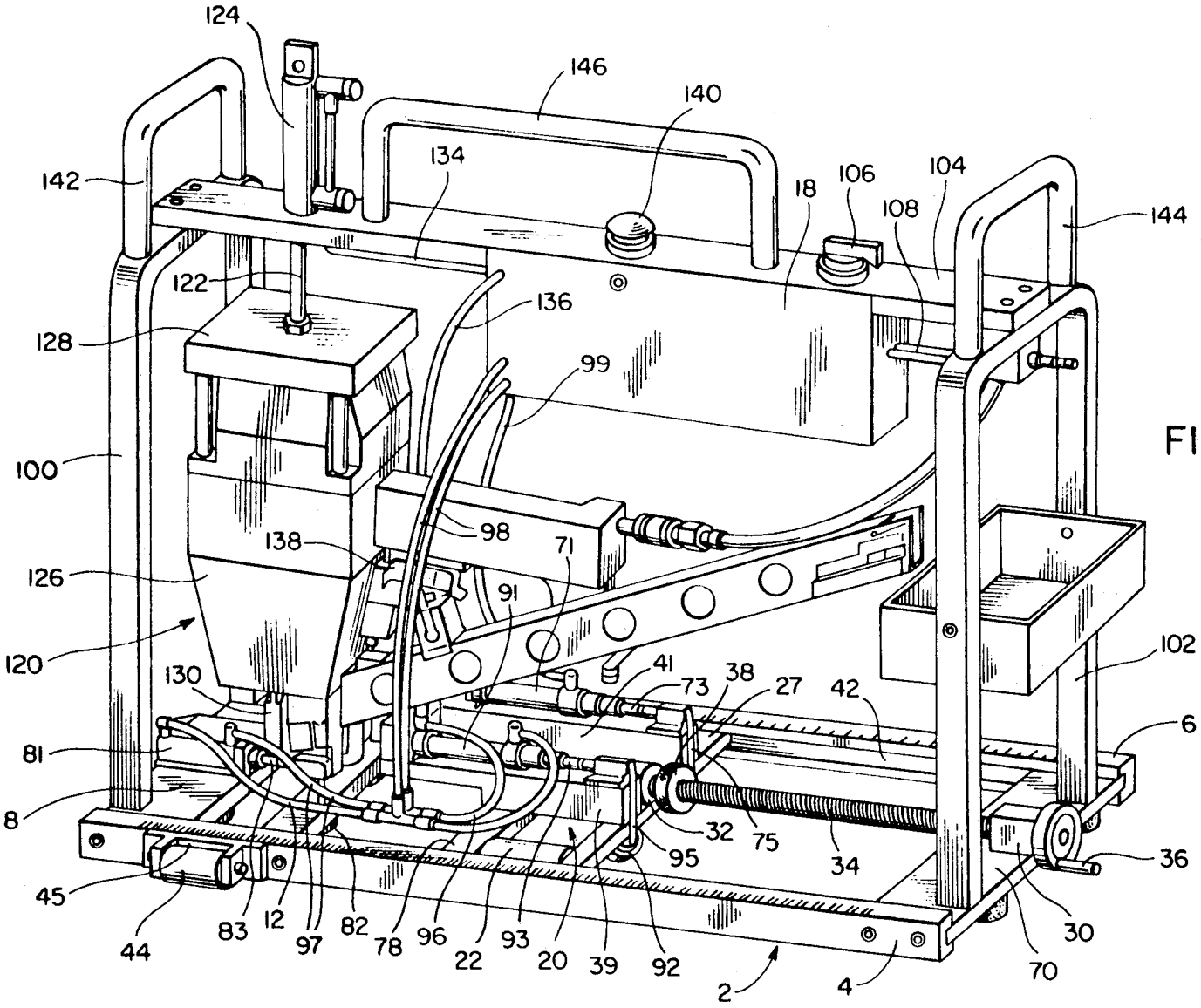
FIG. 1 shows a lateral perspective view of a batten setting device according to the invention, and FIG. 2 a plan view of the underside of the device according to FIG. 1.

The batten setting apparatus according to the invention includes a rigid framework 2 which is formed by two spaced longitudinal members 4, 6, a first transverse member 8 and a connecting member 10. The first transverse member 8 is fastened to the opposing ends of longitudinal members 4, 6, and the connecting member 10 is fastened to the other ends of longitudinal members 4,6 so as to form a substantially rectangular framework of sufficient rigidity.

The opposite ends 14, 16 of a transverse bar 12 are pivotably mounted to the longitudinal members 4, 6 in a distance inside the rectangular frame 4, 6, 8, 10 to the first transverse member 8 which roughly corresponds to the widths of a batten strip. The transverse bar 12 bridges over the distance between longitudinal members 4, 6 parallel to the first transverse member 8.

A carriage 20 is mounted to the longitudinal members 4, 6. To this end guiding grooves are formed in the facing longitudinal surfaces of longitudinal members 4, 6 which extend from the connecting member 10 the vicinity of the transverse bar 12. In the drawings only the guiding groove 42 of longitudinal member 4 is shown (FIG. 1). Slideparts 24, 26 are fixidly mounted to the ends of carriage 20 which are adjacent longitudinal member 4 and longitudinal member 6, respectively. Slidepart 24 extends into groove 42, and slidepart 26 extends into the corresponding groove within longitudinal member 6. Thus, carriage 20 may be shifted within and parallel to the longitudinal members 4, 6.

An adjustment means is mounted to the carriage 20 and comprises a mounting block 30 fastened to the upper surface of connecting member 10 in the middle between longitudinal members 4, 6, a driving block 32 fastened to the upper surface of carriage 20, and a spindle 34, which extends through mounting block 30 and driving block 32 and is equipped with a handle 36 at its free end outside the framework 2. The spindle 34 is rotatably supported within mounting block 30 so as not to be movable axially. A through bore through driving block 32 through which spindle 34 extends has an inner thread mating the outer thread of spindle 34. A counternut 38 rides on the spindle portion 35 extending between driving block 32 and mounting block 30 which serves blocking further rotation of the spindle 34 when being tightened against driving block 32. Thus, by loosing nut 38 carriage 20 may be adjusted to any desired position with respect to the first transverse member 8 lengthwise the longitudinal members 4, 6 by rotating handle 36.

The apparatus includes three sets of rollers. A first set is provided adjacent the first transverse member 8 and the transverse bar 12 and includes a first roller 44 mounted to an outwardly facing surface of longitudinal member 4 so as to be able to rotate about an axis parallel to longitudinal member 4. The second roller 64 of the first set is mounted opposite the first roller 44 to the outwardly facing surface of longitudinal member 6 so as to be able to rotate about an axis parallel to longitudinal member 6. To this end each of rollers 44, 64 is rotatably mounted to a support bracket 45, 65 mounted to the longitudinal member 4, 6 respectively. The support brackets 45, 65 allow each roller 44, 64 to extend over the distance between first transverse member 8 and transverse bar 12. Moreover, a portion of the cylindric outer surface of each roller 44, 64 projects below the underside of framework so as to allow the framework 2 to roll upon a batten strip not shown by means of rollers 44, 64.

A second pair of rollers includes rollers 22, 28 which are mounted to the carriage 20. Roller 22 is mounted adjacent slidepart 24 and roller 28 is mounted adjacent slidepart 26. Rollers 22, 28 may rotate about an axis which is parallel to the axis of rotation of rollers 44, 64. Portions of the cylindric circumferential surface of rollers 22, 28 project below the underside of framework 2 so as to allow the framework 2 to roll upon another batten by rollers 22, 28.

A third pair of rollers is provided which includes rollers 46 and 66 each held within a support bracket 47, 67. Brackets 47, 67 are mounted to the outwardly facing surfaces of longitudinal members 4, 6 adjacent the connecting member 10. The rotational axis of both rollers 46, 66 extend parallel to the axis of rollers 22, 28 and allow the framework 2 to roll upon another mounted batten.

A number of seven abutment elements 52, 54, 56, 58, 72, 74, 76 project below the underside of framework 2. A first row 50 of abutments elements 52, 54, 56, 58 are mounted to the lower surface of the first transverse member 8. The first row 50 of the abutments elements extends along the first transverse member 8 and perpendicular to the longitudinal direction of longitudinal members 4, 6.

A second row 70 of abutment elements 72, 74, 76 is mounted to a second transverse member 78, which is formed of the front portion of carriage 20 and extends parallel to the first transverse member 8.

All abutment elements are similar in their construction so that only abutment element 52 is more specifically explained. Abutment element 52 comprises a shaft 51 the not shown head of which is pressed fits in to a blind bore drilled into the lower surface of first transverse member 8. The portion of shaft 51 which projects below the lower surface of first transverse member 8 supports unrotatably the inner shell 53 of a ball bearing 55. Thus, the outer shell 57 of ball bearing 55 is freely rotatable about the axis of shaft 51 which is perpendicular to the lower surface of first transverse member 8.

Clearly, instead a ball baring 55 any different pulley may be mounted to shaft for being freely rotatable about the axis of shaft 51. However, such pulley has to withstand a substantial radial force developped by the pressure elements as will be explained hereinafter.

Thus, according to the disclosed embodiment of the invention each abutment element 52, 54, 56, 58, 72, 74, 76 includes a ball bearing the outer shell of which is freely rotatable about an axis perpendicular to the plane as defined by the framework 2.

While the abutment elements of the second row 70 are equally spaced along the second transverse member 78 the first row 50 includes a first peripherial abutment element 52 and an opposite peripherial abutment element 58 and two intermediate abutments 54, 56 which are arranged closer together than abutment elements 52, 54 or 56, 58, respectively.

A first row 80 of pressure elements 82, 84, 86, 88 extends parallel to the first row 50 of abutment elements. The pressure elements 82, 84, 86, 88 are each mounted to the lower surface of the transverse bar 12 such that each abutment element 52, 54, 56, 58 opposes an associated pressure element 82, 84, 86, 88. Each pressure element 82, 84, 86, 88 has the same form and construction as the abutment elements and therefore, comprises a shaft fixidly mounted to the transverse bar 12 and a ball bearing fastened to the free end of the shaft. The outer shell of each ball bearing of the pressure elements 82, 84, 86, 88 is freely rotatable about the corresponding shaft.

A second row 90 of pressure elements 92, 94 is provided on carriage 20 which is associated to the second row 70 of abutment elements 72, 74, 76. Each pressure element 92, 94 comprises a ball bearing the outer shell of which is freely rotatable about a shaft to which the ball bearing is fastened.

Carriage 20 is formed from a plate into which two rectangular openings 21, 23 are cut. Within the first opening 21 roller 22 is mounted and within the second opening 23 roller 26 is mounted. The front portion of the plate is the second transverse member 78 connected to a rearward portion 27 of carriage 20 by three legs 31, 33, 37.

A first block 39 is fastened to rearward portion 27 and to member 78 for supporting a first pneumatic motor 91 for pressure element 92. The piston rod 93 of cylinder 91 is pivotably coupled to one end of a lever 95. Lever 95 may swivel about a pin (not shown) mounted to rearward portion 27 so as to be able to swivel about an axis parallel to the pivot axis of transverse bar 12. The free end of lever 95 holds the pressure element 92.

A second block 41 is fastened to rearward portion 27 and to member 78 opposite to block 39 with respect to driving block 32 for supporting a second pneumatic motor 71. Piston rod 73 of cylinder 71 is pivotably coupled to one end of a lever 75. Lever 75 is pivotably coupled to the rearward portion 27, and the free end thereof supports the pressure element 94. Thus, under control of motors 91 and 71 the pressure elements 92, 94 may rock about an axis which is parallel to the rows 70 of the associated abutment elements.

For pivoting the transverse bar 12 two further parallel pneumatic motors are mounted on the upper surface of the first transverse member 8. Pneumatic cylinder 81 is fastened to member 8, and the piston rod 83 is rockably coupled to a first upward projection 85 of bar 12. A cylinder 87 of a second pneumatic motor is mounted on the upper surface of first transverse member 8 and has a piston rod 89 which is rockably coupled to a not shown further upward projection of bar 12.

Pressure lines 96 connected to cylinder 91 and pressure lines 97 connected to cylinder 81 communicate with pressure lines 98 which are coupled to a control box 18. Similar pressure lines connecting cylinder 71 and cylinder 87 communicate with pressure lines 99 which are coupled to a control box 18.

A first bow 100 is uprightly fastened to first transverse member 8, and a second bow 102 is uprightly fastened to connecting member 10. A plate 104 connects the upper portions of the first bow 100 and the second bow 102. The control box 18 is fastened to the connecting plate 104, and a first control knob 106 projects upwardly from the connecting plate 104. The control box 18 includes a manifold for pressurized air comprising valves and conduits for allowing the various functions to be carried out by the apparatus as described herein. Connecting pressure lines 108 are provided which may connect the control box 18 to a not shown source of pressurized air. It may be understood that pressure lines 98 and 99 are connected through the manifold within the control box 18 to a source of pressurized air in case the control knob 106 is manipulated correspondingly. Thus, when all four pneumatic motors 71, 91, 81, 87 are activated by the corresponding pressure line the associated piston rods 73, 93, 83, 89 are shifted to one end of the corresponding cylinders with the result that transverse bar 12 will turn in clockwise direction as will do the row 90 of second pressure elements 92, 94. On the other hand, when the motors 71, 91, 81, 87 are deactivated by pressurizing the corresponding pressure lines the associated piston rods 73, 93, 83, 89 are withdrawn into the cylinders with the result that transverse bar 12 and the row 90 of second pressure elements 92, 94 will turn in counter clockwise direction.

An automatic nailing device 120 is mounted to the first transverse member 8 and to the piston rod 122 of a pneumatic cylinder 124. The pneumatic cylinder 124 is fastened to a front portion of plate 104, and the piston rod 124 is mounted to the cover of the body 126 of the nailing device 120 and extends through a bore within plate 104. The nailing head 128 is guided within vertical rails 130, 132 fastened to the first transverse member 8. A pressure line 134 connects the pneumatic cylinder 124 to the control box 18, and a pressure line 136 connects the trigger 138 of the nailing device 120 to the control box 18. A push button 140 is provided at the control box for triggering the automatic nailing device 120.

Handles 142, 144 are mounted to the top of the bow 100 and 102 so that the apparatus may easily be carried by hand. Another handle 146 is fastened to the plate 104 which allows shifting the apparatus along the batten strips.

Figure 2:
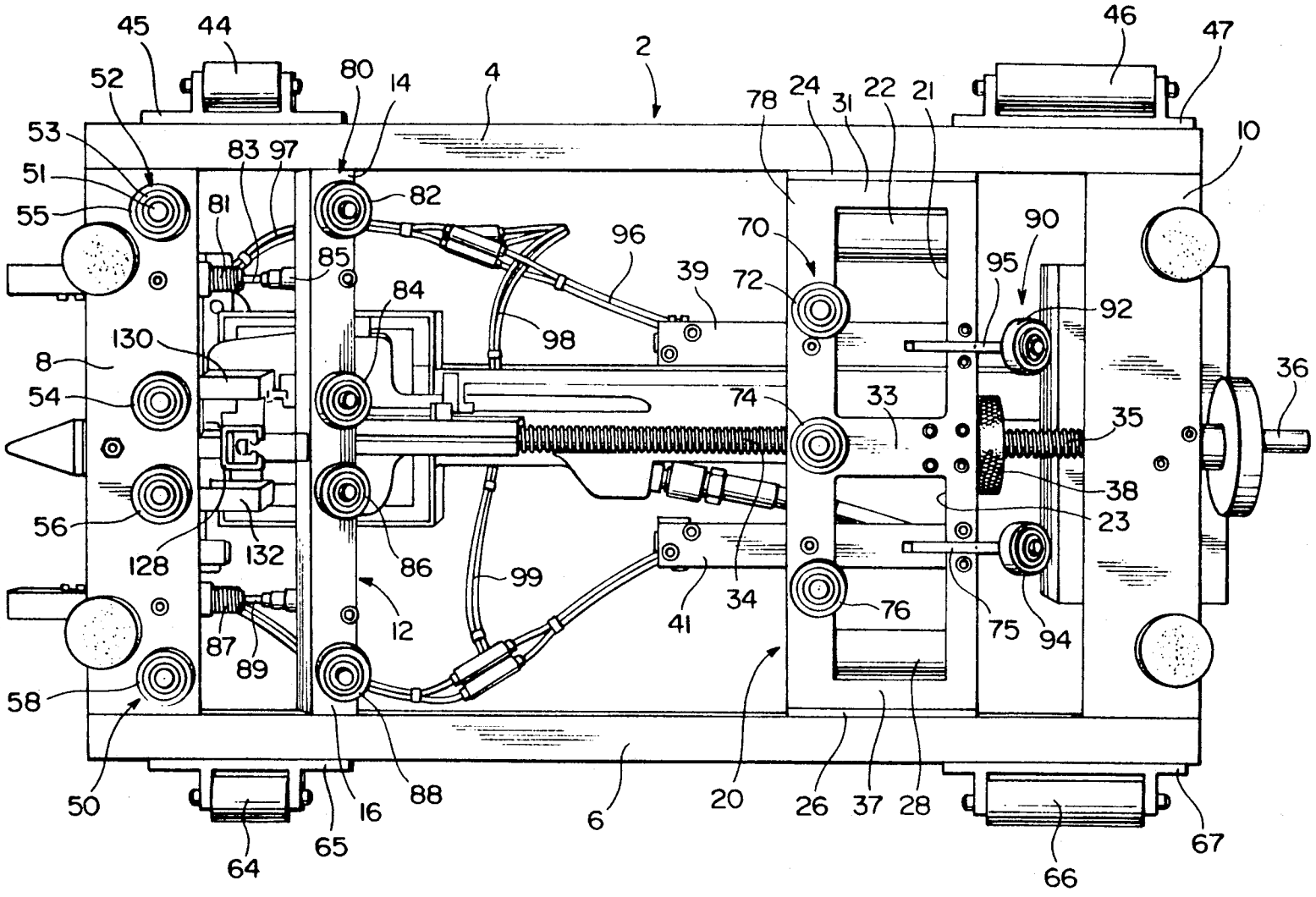

For laying and mounting a batten strip in a predetermined distance above a mounted batten strip the control knob 106 is turned to a position which causes release of the first row 80 of first pressure elements and of the second row 90 of second pressure elements according to which the pressure elements will assume a position as shown in FIG. 2.

The apparatus is then placed on the last mounted batten strip so that the second row 70 of abutment elements 72, 74, 76 engages the upwardly facing longitudinal surface of the mounted batten strip. A new batten strip to be mounted is laid into the space between the first row 50 of first abutment elements and the first row 80 of pressure elements.

When manipulating the control knob 106 into a position which causes activation of the motors 71, 81, 91, 87 the first row 80 of pressure elements swings clockwise in forceful engagement to the lateral surface of the batten strip to be mounted which now is clamped between the first row 80 of pressure elements and the first row 50 of abutment elements. Simultaneously apparatus is firmly held on the mounted batten strip because the second row 90 of pressure elements has clamped said mounted batten strip between the second row 70 of abutment elements and the second row 90.

It is to be understood that the ball bearings or pulleys of each of the pressure elements 82, 84, 86, 88, 92, 94 and of each of the abutment elements 52, 54, 56, 58, 72, 74, 76 are now in a common plane below the framework 2 such that the abutment elements and the pressure elements clamp the batten strips approximately at the middle of their thickness whereas rollers 44, 64 and 22, 28 rest and roll upon the batten strips.

The batten strip now clamped between row 50 and row 80 is ready for being mounted. Therefore, the operator presses push button 140 which activates motor 124. This causes the nailer to move downwardly towards the clamped batten strip and thereafter a pressure pulse through pressure line 136 triggers the nailing head with the result that the batten strip now is nailed upon a rafter not shown. When viewing FIG. 2 it may be noted that the batten strip is held by abutment elements 54 and 56 and pressure elements 84, 86 in close vicinity to the nailing head 128.

The operator then rolls the apparatus along the mounted batten strip and after a desired distance when the next rafter appears below the nailing head another nail is shot into the batten strip to be mounted.

For releasing the apparatus or for inserting another batten strip to be mounted the control knob 106 has to be manipulated correspondingly as explained above.

What is claimed is:

1. Batten setting apparatus comprising:

a framework including a first transverse member and a second transverse member extending parallel to said first transverse member, a plurality of first abutment elements being arranged in a row and being mounted on said first transverse member, a plurality of second abutment elements extending in a row parallel to the row of the first abutment elements and being mounted on said second transverse member, a distance between the row of the first abutment elements and the row of the second abutment elements defining a predetermined distance between a mounted batten and a batten to be mounted, a plurality of pressure elements being arranged in a row extending parallel to the row of the first abutment elements and being pivotably mounted as a group with respect to the framework, and at least one motor being mounted on the framework and being coupled to the pressure elements for clamping a batten between the pressure elements and one of the rows of abutment elements by pivotal movement of the pressure elements towards said one of the rows of abutment elements when the motor is activated.

2. Apparatus according to claim 1, wherein the motor is a pneumatic motor.

3. Apparatus according to claim 1, wherein a nailer is mounted to the framework and has a nailing head adapted to extend between the row of abutment elements and the associated row of pressure elements.

4. Apparatus according to claim 3, wherein the nailer and the motor may be coupled to a common energy source, each for being activated thereby.

5. Apparatus according to claim 1, wherein the pressure elements are mounted to a clamping bar which is coupled to the motor and which is pivotably mounted to the framework.

6. Apparatus according to claim 5, wherein the pressure elements project from a lower surface of the clamping bar.

7. Apparatus according to claim 1, wherein the row of first and the row of second abutment elements project from a lower surface of the first and the second transverse members.

8. Apparatus according to claim 1, wherein the row of pressure elements is mounted to the framework between the first transverse member and the second transverse member.

9. Apparatus according to claim 8, wherein a plurality of first pressure elements is movably mounted to the framework in vicinity to a row of first abutment elements so as to be adapted to clamp a batten to be mounted between the first abutment elements and the first pressure elements; a row of second abutment elements being mounted to a second transverse member and a row of second pressure elements being movably mounted to the framework so as to be adapted to clamp a mounted batten between the row of second abutment elements and the row of second pressure elements.

10. Apparatus according to claim 9, wherein the second pressure elements are coupled to at least one second motor.

11. Apparatus according to claim 9, wherein the second abutment elements and the second pressure elements are mounted to a carriage which is adjustably held by the framework and is coupled to adjustment means for adjusting the distance between the row of the first abutment elements and the row of the second abutment elements.

12. Apparatus according to claim 11, wherein the adjustment means comprise a spindle mounted to the framework and coupled to the carriage.

13. Apparatus according to claim 1, wherein each abutment element of the first and the second abutment elements and each pressure element is provided with a pulley.

14. Apparatus according to claim 1, wherein a first pair of rollers is provided between the row of first abutment elements and the row of associated pressure elements so that the apparatus may roll on a batten to be mounted.

15. Apparatus according to claim 14, wherein at least a second pair of rollers is provided in vicinity of the row of second abutment elements so that the apparatus may roll on a mounted batten.

* * * * *